US009494316B2

(12) United States Patent
Vestin

(10) Patent No.: US 9,494,316 B2
(45) Date of Patent: Nov. 15, 2016

(54) HEATING DEVICE INCLUDING CATALYTIC BURNING OF LIQUID FUEL

(75) Inventor: Anders Vestin, Malmö (SE)

(73) Assignee: ZEmission AB, Lund (SE)

( * ) Notice: Subject to any disclaimer, the term of this patent is extended or adjusted under 35 U.S.C. 154(b) by 953 days.

(21) Appl. No.: 12/522,014

(22) PCT Filed: Jan. 7, 2008

(86) PCT No.: PCT/SE2008/050012

§ 371 (c)(1),
(2), (4) Date: Feb. 17, 2010

(87) PCT Pub. No.: WO2008/082361

PCT Pub. Date: Jul. 10, 2008

(65) Prior Publication Data

US 2010/0139599 A1 Jun. 10, 2010

(30) Foreign Application Priority Data

Jan. 5, 2007 (SE) ..... 0700031

(51) Int. Cl.
*F23D 11/44* (2006.01)
*F23C 13/02* (2006.01)

(52) U.S. Cl.
CPC ..... *F23C 13/02* (2013.01); *F23D 11/443* (2013.01)

(58) Field of Classification Search
CPC ..... F23C 13/00
USPC ..... 431/100, 208, 268
See application file for complete search history.

(56) References Cited

U.S. PATENT DOCUMENTS 1,347,631 A * 7/1920 Herck ..... 431/258
1,502,807 A * 7/1924 Berger ..... 431/7

(Continued)

FOREIGN PATENT DOCUMENTS

DE 100 14 092 9/2000
DE 10014092 * 9/2000

(Continued)

OTHER PUBLICATIONS

DE 10014092 A1 Machine Translation, accessed by Examiner on Feb. 4, 2014, via Espacenet translation http://translationportal.epo.org/emtp/translate/?ACTION=description-retrieval&COUNTRY=DE&ENGINE=google&FORMAT=docdb&KIND=A1&LOCALE=en_EP&NUMBER=10014092&OPS=ops.epo.org&SRCLANG=de&TRGLANG=en.*

(Continued)

*Primary Examiner* — Avinash Savani
*Assistant Examiner* — George R Blum
(74) *Attorney, Agent, or Firm* — Merchant & Gould P.C.

(57) ABSTRACT

A heating device (100) for combustion of liquid fuels comprises at least one catalytic element (140) for catalytically burning a mixture of fuel and air, a fuel supply means (133) being disposed on an upstream side of said first catalytic element (140) and an air supply means (132) being disposed on an upstream side of said at least one catalytic element (140). A fuel-evaporating device (130) has a substantially axisymmetric shape and an upstream end and a downstream end. The fuel-evaporating device is heated, during operation, by the at least one catalytic element (140), and is supplied with fuel and air from the fuel supply means (133) and the air supply means (132). The heating device also comprises an outer housing (110), for containing said catalytic element (140) and said fuel-evaporating device (130). The fuel-evaporating device (130) is provided with at least one inner inlet pipe (132; 132*b*) in the generally upstream end thereof. The pipe (132; 132*b*) is arranged to inject fuel and/or air in a tangential direction into the generally upstream part of the fuel-evaporating device (130) such that a rotational flow is obtained therein. Moreover, the generally upstream end of the fuel-evaporating device (130) is arranged in the vicinity of the at least one catalytic element (140).

8 Claims, 6 Drawing Sheets

(56) References Cited

U.S. PATENT DOCUMENTS 3,299,938 A * 1/1967 Bally ..... F23D 14/12 126/92 R
3,862,907 A * 1/1975 Shimotsuma et al. ..... 252/373
4,189,294 A * 2/1980 Rice ..... F23D 14/18 126/39 J
4,443,228 A * 4/1984 Schlinger ..... C01B 3/363 239/112
4,443,230 A * 4/1984 Stellaccio ..... C10J 3/506 252/373
4,927,353 A * 5/1990 Nomura ..... F23L 15/04 126/91 A
5,203,690 A * 4/1993 Maruko ..... F23C 3/00 431/170
5,251,609 A * 10/1993 Thibault ..... F23D 14/18 126/39 J
5,375,996 A * 12/1994 Nakamura et al. ..... 431/115
5,375,997 A * 12/1994 Nakamura ..... F23D 14/12 126/39 J
5,388,985 A * 2/1995 Musil ..... F23C 3/00 431/116
5,464,006 A * 11/1995 Ledjeff ..... F24H 1/0045 122/14.1
5,609,833 A * 3/1997 R uhl ..... F23D 14/02 110/210
5,685,156 A * 11/1997 Willis ..... F23R 3/40 60/39.511
5,707,226 A * 1/1998 Bogtstra ..... 431/215
5,709,174 A * 1/1998 Ledjeff ..... F23C 6/04 119/167
6,065,957 A * 5/2000 Kondo ..... F23C 9/00 431/116
8,021,144 B2 * 9/2011 Vestin ..... F23C 13/02 431/11
2003/0188486 A1 10/2003 Tanaka et al.
2004/0142291 A1 * 7/2004 Yang ..... F23C 13/00 431/7
2004/0154222 A1 * 8/2004 Burch ..... B01J 19/2485 48/127.9
2004/0161717 A1 * 8/2004 Suzuki ..... F23C 13/00 431/170
2005/0235654 A1 * 10/2005 Kaupert ..... B01B 1/005 62/50.2
2006/0107663 A1 * 5/2006 Filippone ..... F02G 1/04 60/643
2006/0260322 A1 * 11/2006 Prade ..... F23C 13/00 60/777
2010/0285416 A1 * 11/2010 Moller ..... F23D 14/18 432/4
2011/0165300 A1 * 7/2011 Roychoudhury ..... F23C 13/00 426/523

FOREIGN PATENT DOCUMENTS

DE 10014092 A1 * 9/2000 ..... F23C 13/00
DE 10114092 9/2000
EP 1 126 216 8/2001
JP 61-134515 6/1986
JP 61134515 6/1986
JP 61134515 A * 6/1986
JP 09-004821 10/1997
JP 2000-028109 A 1/2000
JP 2000-274605 A 10/2000
JP 2001-050508 2/2001
WO WO 2007/003649 1/2007
WO WO 2007003649 A1 * 1/2007 ..... F23C 13/00

OTHER PUBLICATIONS

Swedish Office Action for Application No. 0700031-8 dated Jul. 13, 2007.
Korean Office Action mailed Dec. 9, 2013, 5 pages.
Canadian Office Action for corresponding CA Application No. 2674468 dated Feb. 27, 2014 (2 pages).
Extended European Search Report for corresponding EP Application No. 08 70 5285 dated Apr. 2, 2014 (9 pages).

* cited by examiner

HEATING DEVICE INCLUDING CATALYTIC BURNING OF LIQUID FUEL

This application is a National Stage Application of PCT/SE2008/050012, filed 7 Jan. 2008, which claims benefit of Serial No. 0700031-8, filed 5 Jan. 2007 in Sweden and which application(s) are incorporated herein by reference. To the extent appropriate, a claim of priority is made to each of the above disclosed applications.

FIELD OF THE INVENTION

The present invention generally relates to a heating device utilizing catalytic combustion, and more specifically the invention relates to such a heating device for liquid fuels. It further relates to a stove having a heating device of the invention.

BACKGROUND OF THE INVENTION

Catalytic combustion in general has many advantages compared to conventional gas phase combustion. The most obvious advantages are the very low emissions, high safety (normally no flame is present and the gas mixture is too lean for gas phase ignition), controllability, insensitivity to rapid pressure/flow fluctuations, wide power range and silent operation. Typical disadvantages are the requirements of complete fuel evaporation and homogenous air/fuel mixture to eliminate the risk for thermal degradation of the catalyst. Due to the fuel evaporation requirement, combustion of gaseous fuels presents fewer challenges than liquid fuel combustion and the commercial applications are increasing. However, when it comes to catalytic combustion of liquid fuels there are still few, if any, commercial applications due to the problem to achieve complete and efficient evaporation of hydrocarbon fuels without accumulation of heavy hydrocarbon residues. Another typical disadvantage is the (electrical) energy and time needed to heat the catalytic material at start-up. This particular disadvantage has so far disqualified catalytic combustors in applications where a rapid start is crucial. Using a flame for heating at start-up results in increased emissions depending on how the combustor is operated i.e. how often the burner is started during an operating cycle. Furthermore, a flame pre-heater complicates the system since it requires fuel atomization devices and a separate flame igniter. Therefore, there is a need for a fast and low-emission start-up principle for a catalytic combustor, consuming a minimum of electrical energy. Prior art electrical start-up devices have the disadvantages of consuming a lot of electrical energy and requiring long heating time. This will delay the ignition of the catalyst, which leads to emission of high levels of unburned hydrocarbons and carbon monoxide.

JP 61-134 515 describes a catalytic burner injecting a liquid fuel spray in a swirling airflow. The fuel pump necessary to inject the fuel provides a relatively high pressure, which is costly from a power consumption point of view. The pump needed for generating high pressure also increases the cost of the assembled unit. Furthermore, preheating of the inlet air in a heat exchanger is needed to obtain complete evaporation of the fuel which further increases the complexity and cost of the assembled unit. U.S. Pat. No. 5,685,156 describes a catalytic burner for e.g. a gas turbine. This burner also requires significant amounts of power to energize the fuel pump and also demands a relatively costly pump solution.

DE 100 14 092 describes a catalytic burner having preevaporation of the fuel; after the evaporation of the fuel, the fuel is mixed with preheated air, whereupon the fuel/air mixture will pass a catalytic element and combust. The burner according to DE 100 14 092 demands fuel with a high purity and a narrow boiling range, otherwise coking and/or distillation of the fuel will occur.

US 2005/0235654 describes a catalytic burner in which the fuel is evaporated by drenching of a felt like material on a bottom of an evaporator. This solution will have the same problems as the burner of DE 100 14 092.

The problem with evaporation of liquid fuels lies in the fact that the evaporator temperature must be controllable depending on the operating conditions of the burner matching the wide power range and excellent controllability of the catalytic combustion process and accumulation of heavy hydrocarbon residuals must be prevented in order to avoid coking. Furthermore, the evaporator must reach a suitable temperature in short time during start-up in order to obtain a fast and efficient start-up process improving performance and minimizing cold start emissions. Finally, this has to be accomplished with a minimal consumption of electrical energy.

SUMMARY OF THE INVENTION

In order to mitigate, alleviate or eliminate at least partly one or several of the above-mentioned problems, it is an object of the present invention to provide a heating device having an inlet pipe that directs air and fuel in a tangential direction into a fuel-evaporating device, such that a strong swirl is created therein.

Further objects and aspects of the invention are given by the dependent claims.

BRIEF DESCRIPTION OF THE DRAWINGS

Further objects, features and advantages of the invention will become apparent from the following detailed description of several embodiments of the invention with reference to the drawings, in which.

DETAILED DESCRIPTION OF EMBODIMENTS

Figure 1:
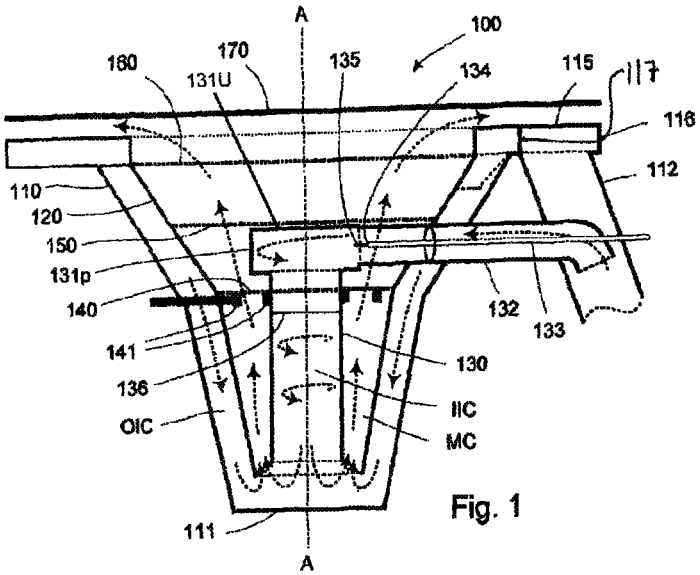
FIG. 1 is a cross-sectional view of a heating device according to the invention.
Figure 2:
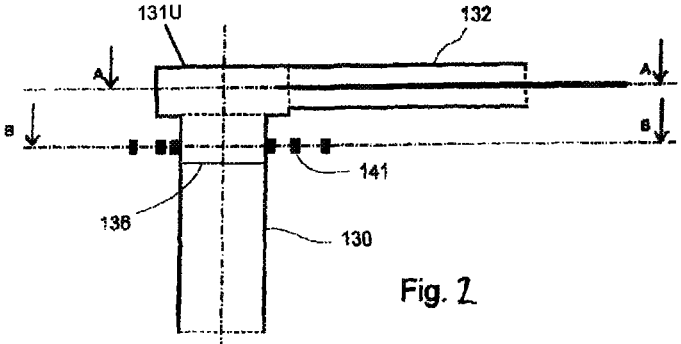
FIGS. 2-3 show one embodiment of a fuel-evaporating device according to one embodiment of the invention.
Figure 3:
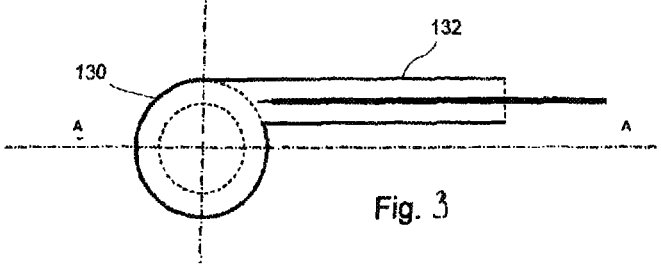
Figure 4:
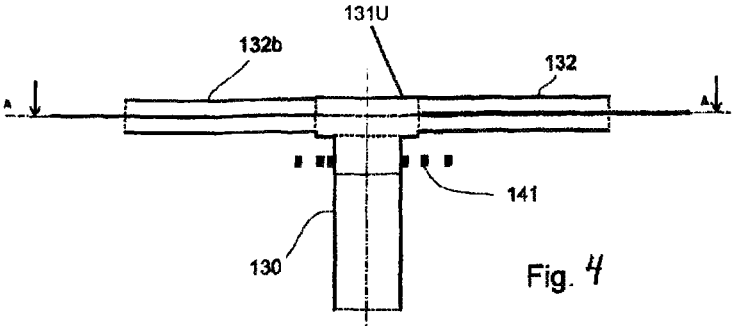
FIGS. 4 and 5 show different variations of embodiments for the fuel-evaporating device according to the invention.
Figure 5:
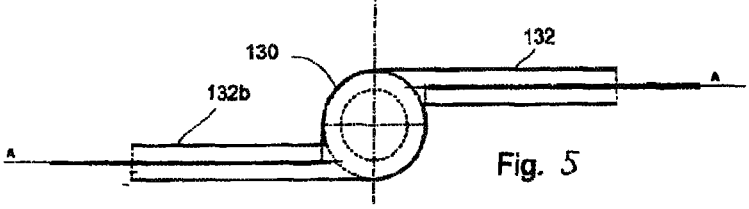
Figure 6:
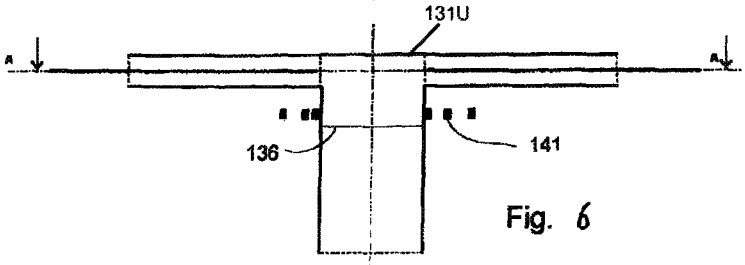
FIG. 6 is a cross-section of the fuel-evaporating device along the line A-A in FIG. 5.

One embodiment of a heating device 100 can be seen in FIG. 1. The heating device 100 comprises an outer housing 110, substantially having a shape of a truncated cone with a large opening facing upwards. The bottom of the outer housing 110 is closed, e.g. having a smoothly curved or substantially flat bottom wall 111, which fluidly closes off the lower part of the outer housing 110 forming a pan. An inner wall 120 is arranged inside of the outer housing 110, and this wall substantially has a shape of a truncated cone, with the large opening facing upwards. A top wall 115 is attached to the outer housing 110 and the inner wall 120 at their upper peripheries, such that a fluid tight lid is formed above the space between the outer housing 110 and inner wall 120. This space is hereinafter referenced as outer inlet chamber OIC. The inner wall 120 ends at a distance from the bottom wall 111, such that a fluid can transfer from the outer inlet chamber OIC to the interior of the inner wall 120. The outer housing 110 and the inner wall 120 are arranged substantially coaxially.

An outer inlet pipe 112 is connected to the upper part of the outer housing 110. The outer inlet pipe 112 is arranged to direct a fluid flow tangentially to the outer housing 110 and the inner wall 120, and with an initially horizontal orientation. The flow will eventually spiral downwards towards the outlet close to the bottom wall 111. In one embodiment, a foil or wing can be arranged in the outer inlet chamber to further help direct the flow into a coaxial rotating flow.

A fuel-evaporating device 130, hereinafter also referenced as fuel evaporator, is arranged substantially coaxially inside the inner wall 120. The fuel evaporator generally has the shape of a cylinder with a circular cross-section, and the upper part of the fuel evaporator is closed by an upper wall 131*u*. A bottom portion of the fuel evaporator is open and faces the bottom wall 111 of the outer housing 110. The peripheral wall surface inside the upper portion of the fuel evaporator 130 is the main evaporation zone. The cross-section of the fuel evaporator 130 does not have to be circular, but should be substantially axisymmetric.

The total volume inside the fuel evaporator is referenced as the inner inlet chamber IIC. The volume between the outside surface of the fuel evaporator 130 and the inside surface of the inner wall 120 is referenced as the mixing chamber MC.

An inner inlet pipe 132 is connected to the upper part of the fuel evaporator 130. This pipe is configured to direct the incoming fluid tangentially to a peripheral wall 131*p* of the fuel evaporator 130, such that a strong swirl is generated. The inner inlet pipe 132 also incorporates a fuel pipe 133, which supplies fuel from a fuel pump (not shown). The fuel supply pipe can in one embodiment be provided with a nozzle 134, which can be a simple orifice. To form small uniform droplets despite of low fuel pressure (the fuel can be supplied by gravity alone), the nozzle 134 may incorporate a thin wire 135 with a diameter of approximately half of the inner diameter of the nozzle, inserted axially into said nozzle. The wire may e.g. extend a distance from the nozzle of the inlet pipe that corresponds to approximately 10 times the inner diameter of said nozzle. The opening in the lower part of the evaporator acts to discharge the fuel and/or air that is injected in the fuel evaporator through the inner inlet pipe 132.

A first catalytic element 140 is arranged in close proximity to or in direct contact with the fuel evaporator 130. In one embodiment, the catalytic element 140 encircles the evaporator 130 at the upper end thereof, see e.g. FIG. 12 and in another embodiment, the catalytic element 140 encircles the evaporator at a position slightly downward from the upper end of the fuel evaporator. An electric heating element 141 is arranged in contact or in close proximity with the first catalytic element 140. In one embodiment, the electric heating element 141 is also in contact or in close proximity with the fuel evaporator 130. The electric heating element 141 is arranged to substantially heat the catalytic element 140 up to ignition. The electric heating element 141 does not have to cover the entire area of the catalyst 140, since the heat will spread from the heated areas to the entire catalytic structure. The first catalytic element 140 is arranged to substantially cover an entire cross-section between the fuel evaporator 130 and the inner wall 120, as can be seen in FIG. 1, such that substantially all fluid flowing between the fuel evaporator 130 and the inner wall 120 goes through the first catalytic element 140. In one embodiment, the first catalytic element 140 is arranged just above the upper wall 131*u* of the fuel evaporator, and this element extends from the inside surface of the inner wall 120 and covers its entire interior cross-section. The first catalytic element 140 is then arranged in contact with, or in close proximity to the upper wall 131*u*, see e.g. FIG. 11.

The support of the catalytic element 140 is in one embodiment manufactured from metal, such as a metallic net or mesh, but it can in other embodiments have a similar shape with a substantially thin and flat configuration. In another embodiment, the support can be manufactured from a monolith. The monolith or the metallic net or mesh is covered with a ceramic washcoat, which is catalytically active or covered with catalytically active material. The washcoat increases the surface area of the catalytic element substantially, and consequently allows for effective dispersion of the catalytically active material to be deposited on the element 140. The first catalytic element should have a relatively small mass, for allowing it to be pre-heated rapidly. The washcoat can be made from any suitable material, such as aluminum oxide.

A second catalytic element 150 is arranged just above the upper wall 131*u* of the fuel evaporator, and this element extends from the inside surface of the inner wall 120 and covers its entire interior cross-section. The second catalytic element 150 is arranged in contact with, or in close proximity to the upper wall 131*u*. The upwardly expanding cone shape of the inner wall means that the second catalytic element 150 is larger than the first catalytic element 140. The second catalytic element 150 allows for higher power of the heating device. A third and possibly even fourth (or more) additional catalytic elements can be arranged further downstream in the heating device, i.e. above the first 140 and second 150 catalytic elements. The main combustion zone is formed at the upper part of the heating device, at the second catalytic element 150 (and any additional downstream catalytic element), but the first catalytic element 140 is active during most operating conditions. The fuel evaporator 130 may penetrate through the first catalytic element 140 and into the main combustion zone at the second catalytic element 150.

If the support of the first catalytic element 140 is made of metal, this support can be used as the electrical heating element 141 by using the electrical resistance of said support. The electrical heating element 141 may be electrically insulated from the first catalytic element 140 by the washcoat and/or a ceramic substrate of the first catalytic element 140. The electrical heating element 141 may also be a completely electrically insulated electric heating spiral, of which the cross-section is showed in the figures.

The heating device may in one embodiment be provided with a heating plate 170 that substantially covers the upper part of said heating device. This plate 170 may be arranged at a slight distance above the top wall 115, such that a passage is formed there-between. This forms an exhaust passage for the combustion gases. In one embodiment, the gases are gathered in a manifold (not shown) and are lead through an exhaust pipe (not shown) to an outside of the heating device. A heating plate 170 can be useful if the heating device is used in a stove. A pot or a pan can then be placed on the heating plate 170.

In another embodiment of the invention, the plate 170 may be a ceramic plate being transparent in the IR wavelength area. In such an embodiment, the IR radiation emanating from the catalytic element is free to travel through the ceramic plate and heat the pot or pan being placed on the ceramic plate.

The bottom surface of the heating plate 170 can in one embodiment be provided with downwardly projecting small cylinders (not shown) or other means to enhance convective heat transfer. These cylinders will hinder the outwardly directed exhaust flow between the top wall 115 and the heating plate 170, and transfer more heat from convection to the heating plate 170.

The outer 112 and the inner 132 inlet pipes may in another embodiment be interconnected at a position outside the outer housing 110. A fan (not shown) is provided upstream the interconnection for supplying combustion air to the heating device. In one embodiment, the inner inlet pipe 132 extends into the center of the outer inlet pipe 112 and is angled towards the direction of the fan. This creates a slight ramming of inlet air into the inner inlet pipe, which increases the dynamic pressure of the air that is directed to the fuel evaporator 130.

Alternative Embodiments

In one embodiment, the inner wall 120 may have a different cone angle at its upper part than at its lower part, as can be seen in FIG. 1. This makes it possible to have a large catalytic element 150 in the main combustion zone, while the size of the first startup catalytic element 140 can be kept small. A small startup catalytic element decreases the electricity consumption and startup time, thereby reducing emissions of carbon monoxides and unburned hydrocarbons, and a large main catalytic element increases the radiation area of the main catalytic element which in turn increases the maximum power output of the heating device. Any additional downstream catalytic element(s) can be substantially as large as the second catalytic element 150 or larger.

In another embodiment, the outer housing 110 can also have a different cone angle in its upper part. This can be beneficial since the airflow between the outer housing 110 and the inner wall 120 then follows the outer surface of the inner wall more closely. This increases the heat transfer from the inner wall 120 to the airflow in the outer inlet chamber OIC, which is wanted in some applications. The inner wall 120 is heated by the combustion in the interior of the heating device, mainly through radiation from the second catalytic element 150 and any additional downstream catalytic element(s).

The fuel evaporator 130 may have a larger cross-sectional area at its upper part, at the area of the inlet pipe. This increases the area of the fuel evaporator that receives heat from the surrounding catalytic elements 140, 150. It also increases the mass of the evaporator, and this increases the startup time. For this reason, the evaporator may be thermally divided, which means that the upper part is thermally divided from its lower part. This is indicated by a dividing line 136. This can be enhanced by using different materials, such as normal steel in the upper part and stainless steel, with lower thermal conductivity, in the lower part. Another material having yet lower thermal conductivity may also be suitable. In FIG. 1, the upper part of the fuel evaporator is heated by the electric heating element 141, and the thermal division means that only little heat is lost to the lower part of the fuel evaporator. This reduces the mass that is heated at startup, which in turn reduces the power consumption of the electric heating element 141.

It is also possible to use the same material for both parts of the evaporator, but use a thermally insulating material at the dividing line between the two parts, such as a thermally low-conductive spacer or fitting. A thermal division can also be obtained by a reduction of the contact surface in the joints between the different sections of the evaporator.

The upstream part of the fuel evaporator is normally the evaporation zone. The upper part of the fuel evaporator may have a stepped increase in diameter from the downstream end, as seen in FIG. 1, forming a horizontal bottom wall 131*b*. This step traps fuel droplets and increases the residence time for the fuel in the hot evaporation zone, which improves evaporation of heavy fuel fractions. Furthermore, a downstream contraction of the evaporator enhances the swirl therein and will also affect the flow on the outside of the fuel evaporator. This will make it more affected by the surrounding hot gases from the first catalytic element 140. These gases will transfer heat to the fuel evaporator 130 through convection, whereas all catalytic elements 140, 150 will transfer heat through radiation. A larger upper part of the fuel evaporator 130 will consequently be irradiated with more heat. The smaller diameter on the lower part of the fuel evaporator will lead to a reduced mass and surface area of the lower fuel evaporator structure, which means that less heat is transferred from the upper part to the lower part of the fuel evaporator. Less heat is also transferred to the upstream air flow from the fuel evaporator 130.

The heating device of the invention does not have to be conically shaped. The main purpose of this geometry is to ensure a thorough mixing of the two flows at the outlet of the fuel-evaporation device 130 and to reduce the cross sectional area of the annular slit between the inner wall 120 and the outlet of the fuel evaporator 130 to prevent the risk of back-fire. The expansion of the inner wall 120 further leads to a gradually increased area of the catalytic elements 140, 150, which allows for large maximum power of the heating device in combination with a small first catalytic element 140. These features can be accomplished in other ways, as is clear to a person skilled in the art. The inner wall 120 can instead be formed with an expanding portion, having a first and second transition where an inner wall, having substantially parallel walls, connects to the expanding portion.

The fuel-evaporating device 130 is illustrated with substantially parallel walls, but this is not necessary for carrying out the invention. The walls of the fuel-evaporating device 130 may just as well be angled inwards in the direction towards the outlet of said fuel-evaporating device, (e.g. 5-30 degrees). This will have some impact on the flow inside the fuel-evaporating device 130 and also on the outside thereof. Furthermore, the fuel-evaporating device 130 can have sections with different diameters with substantially parallel walls as shown in FIG. 1. This can be beneficial especially if the heating device has a vertical configuration (with reference to the flow direction through the catalytic elements), creating a horizontal wall 131*b* allowing the fuel to be maintained during evaporation in case of temporarily insufficient temperature of the fuel evaporation device 130. To improve the flow field inside and outside the evaporator in the case of different diameters, the evaporator can also be provided with a gradually narrowing section between the two cylindrical sections, see e.g. FIG. 12.

Figure 9A:
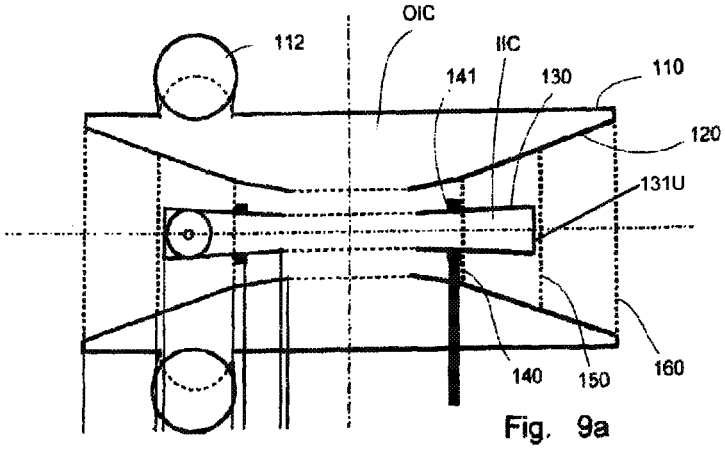
FIGS. 9*a* and 9*b* show a purely radial configuration of the heating device.
Figure 9B:
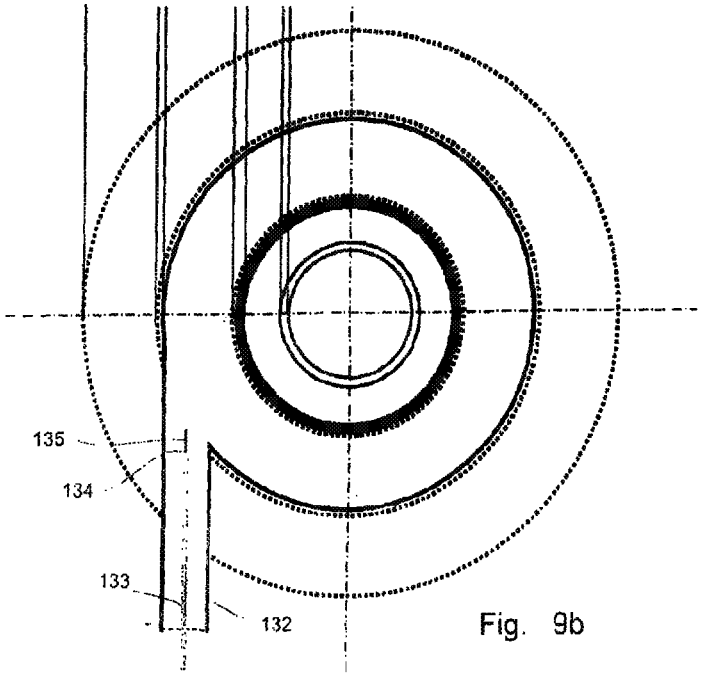

The catalytic heating device of the invention is described as being axial (with reference to the flow direction through the catalytic elements), but can just as well have a radial configuration. In this case, the catalytic elements 140, 150 can be arranged concentrically, with the first catalytic element 140 being placed in the middle, see FIGS. 9*a* and 9*b*. The fuel-evaporating device 130 should in this case have its exit centrally inside the first catalytic element 140 and can also penetrate through said element and the downstream elements as described below for the axial configuration and thus divide each catalytic element into two parts, as seen in FIG. 9*a*.

The flow through the catalytic elements in the described radial configuration is essentially directed radially outwards towards the periphery of the heating device. However, if the heating device is to be used to heat for example the outer surface of a cylinder, a flow directed essentially radially inwards, towards the center of the combustor is beneficial.

Figure 8:
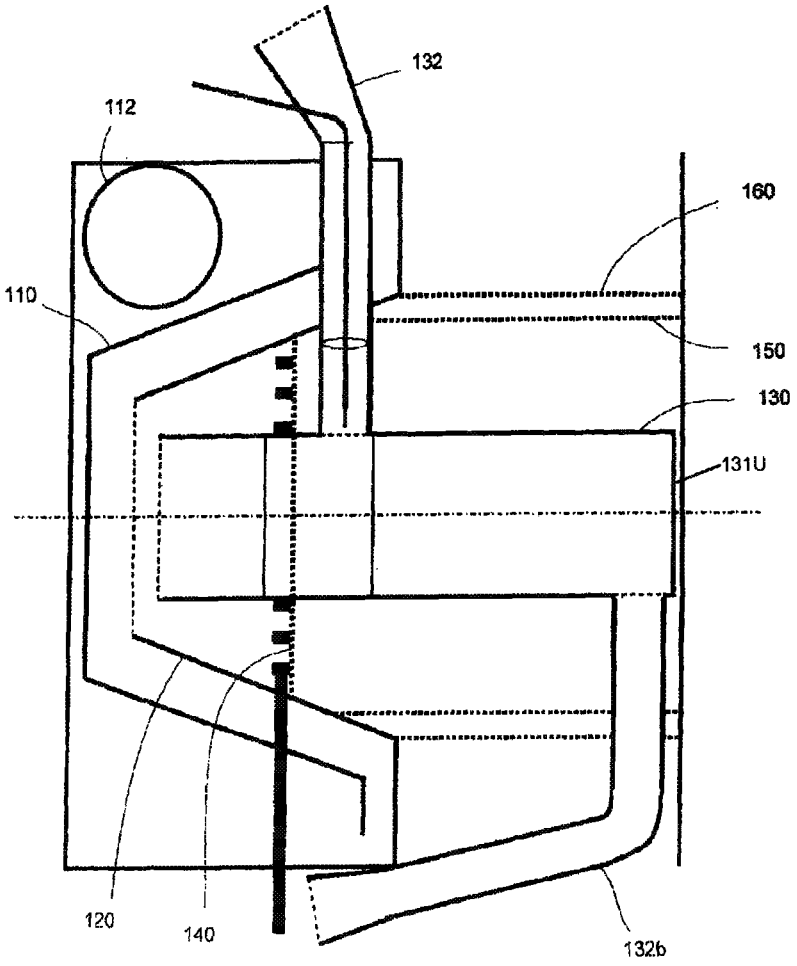
FIG. 8 shows combinations of axial and radial configuration of the heating device.

A mix between axial and radial configuration is also possible where the fuel-evaporating device 130 and the first catalytic element 140 then has an essentially axial configuration resembling the geometry in the first embodiment, whereas the flow direction through the downstream catalytic elements is essentially radial, see FIG. 8.

The fuel evaporation device can penetrate (pass through) different number of catalytic elements both in the axial and radial configurations. In cases where said fuel-evaporating device penetrates many catalytic elements, the mass of the fuel evaporation device is increased. This will result in a higher thermal mass and thus increased consumption of electrical energy during start-up. This problem will be partially overcome by making the fuel evaporating device thermally divided into two or more sections, through two or more divisions 136, 136', thus limiting the part being heated electrically to a section immediately adjacent to the electrical heating element 141 and thereby reduce the thermal mass to be heated electrically, decreasing the electricity consumption at start-up and shortening the heating time.

In some embodiments, the fuel-evaporation device 130 is shown with one tangential inlet. However, to enhance the swirl and/or to make the flow field more symmetric, more than one inlet can be beneficial in some cases as long as the tangential flow velocity in the inlets is sufficient to create the conditions for efficient evaporation mentioned below e.g. FIGS. 4-7 and FIG. 8.

To enhance the load variation potential of the heating device, preheating of the air prior to entering the fuel-evaporation device 130 can be beneficial. To avoid the risk of fuel coking in the fuel injection pipe, only a slight preheating is possible. To avoid this risk completely when having more than one tangential inner inlet pipe, one or more of the inlet pipes 132*b* can be configured without a fuel supply pipe and thus be used exclusively for injecting preheated air into the fuel evaporation device, see FIG. 8. This air flow can then be preheated to higher temperatures e.g. 200-500° C., giving a substantial temperature rise of the total gas flow trough the fuel evaporating device 130.

Another way to accomplish this effect is to enhance the heat transfer to the fuel evaporation device 130 by letting said device penetrate further into the combustion zone, e.g. pass through more of the catalytic elements. In this case, the inlet with the fuel injection pipe can be placed close to the exit of the combustor.

Figure 7:
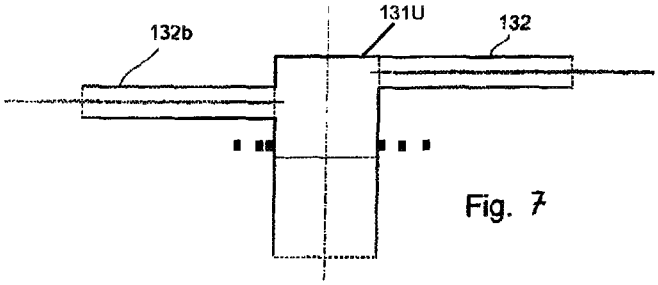
FIG. 7 shows an embodiment with axial displacement between the two inner inlet pipes of the fuel evaporator.

Generally, if multiple inlets are used, see FIGS. 4-7, they can then be positioned at different axial locations along the fuel-evaporating device, see FIG. 7.

Yet another way to accomplish the effect associated with preheating of the air led to the fuel-evaporating device 130 is to induct (recirculate) a flow of hot combustion gases through said fuel-evaporating device. This can be done by making an opening/openings in the upper wall 131*u* of the fuel-evaporating device 130 where the pressure gradient by the rotational velocity component inside said device 130 is used to drive the flow. This pressure gradient creates a lower pressure in the central part of the fuel evaporator.

In case the distance between the fuel injection point (the evaporating surface used when the heating device is in operation) and the part of the fuel-evaporating device 130 which is heated electrically becomes substantial, it can, unless the combustor is mounted vertically, be beneficial to mount the combustor with a slight inclination to make the fuel injected at start-up be transported to the initially heated part by gravity, and also by the airflow.

Figure 13:
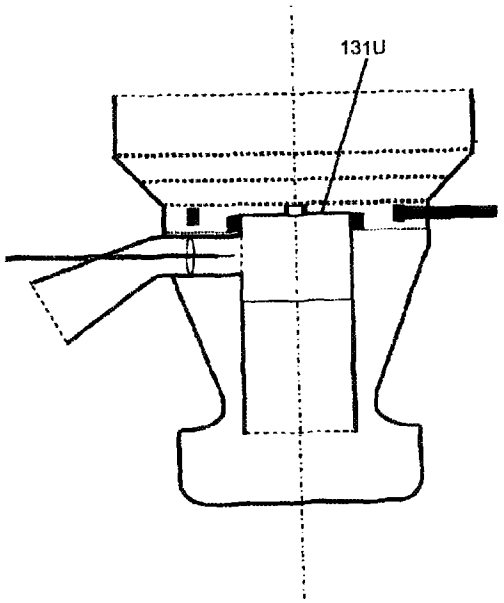
FIG. 12 shows an embodiment in which the fuel evaporator extends beyond the first catalytic element and FIG. 13 shows an embodiment without means for supplying secondary air.

In applications where preheating of the air flow is less important or can be accomplished according to the above embodiments, the outer air flow and the associated annular air channel between the outer housing 110 and the inner wall 120 can be eliminated, thus making the construction less complicated. All airflow will then instead be supplied through the inner inlet pipe(s) 132. In this case, the inner wall 120 is not necessary since no outer inlet flow will enter the heating device 100, see e.g. FIG. 13.

Below, some further embodiments of the invention will be described with reference to FIGS. 10-13.

Figure 10:
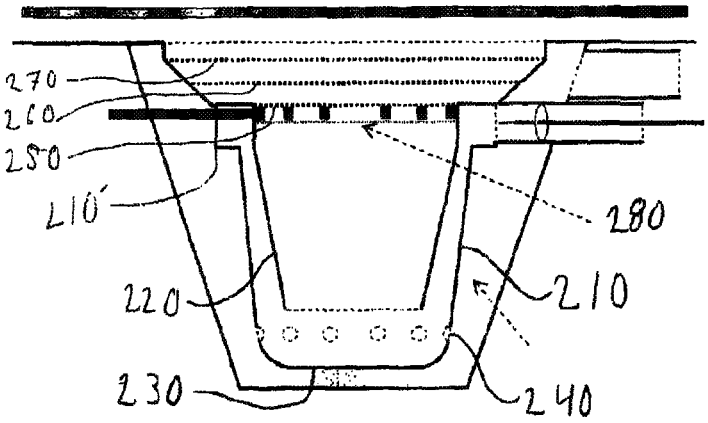
FIG. 10 shows an embodiment of the invention in which the fuel-evaporating device has an annular shape.

In FIG. 1, one embodiment, in which an annular evaporator 200 is used instead of the evaporator 130 shown in FIGS. 1-9 and 11-13, is shown. In the embodiment of FIG. 10, fuel and air enter the annular evaporator 200 in a tangential direction, which gives a swirl to the flow of fuel and air and the evaporation zone is located at the uppermost portion of a circular outer wall surface 210'. The swirling flow propagates downwards, delimited by the circular outer wall 210 and a circular inner wall 220. The inner wall could have the form of a frustum (as shown in FIG. 10), but could also be made from a cylindrical piece of material. The inner wall stops a certain distance from a bottom portion 230 of the outer wall 210, which leaves a pathway for the flow of fuel and air to move inwards, and hence enter an internal space delimited by the inner wall 220. The inward motion of the swirling flow will increase the swirl and hence increase mixing of fuel and air considerably.

In the vicinity of the bottom portion 230, openings 240 could be provided for allowing secondary air to enter the swirling flow of fuel and air. The design of the openings 230 could be such that the secondary air will boost the swirling motion, or be arranged such that the flow of secondary air enters the bottom portion in a radial direction. It should be noted that the embodiment of FIG. 10 may just as well be realized without a secondary air flow, as described above with reference to FIG. 13. Moreover, the evaporator 200 can be thermally divided according to the other embodiments.

As could be understood, the flow of fuel and air will continue in an upwards direction, enclosed by the inner walls 220; eventually, the flow will come in contact with catalytic elements 250, 260, 270, in which elements the combustion will take place. Of course, the number of catalytic elements can be varied, from only one element 250 up to an arbitrary number, e.g. three, five or 10 elements.

Moreover, the device according to the embodiment shown in FIG. 10 is provided with an electrical heating element and other features as described earlier with reference to FIGS. 1-9.

Figure 11:
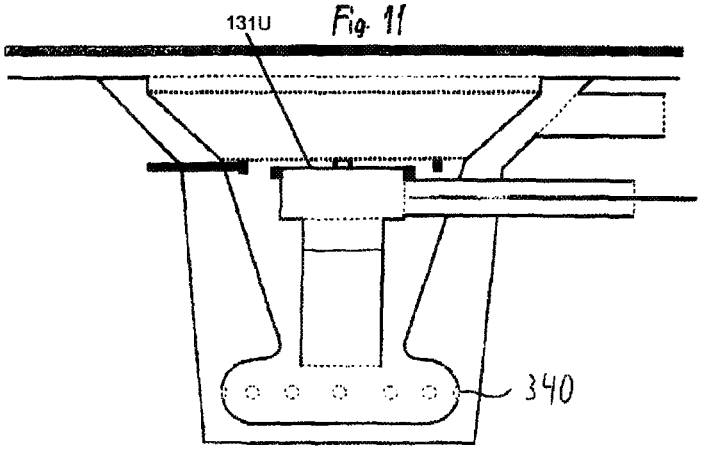
FIG. 11 shows an embodiment comprising a turning chamber.
Figure 12:
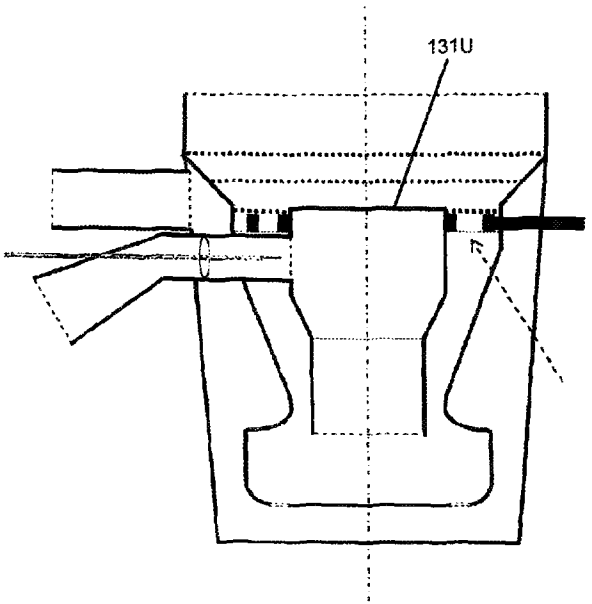

FIG. 11 shows an embodiment resembling the embodiment of FIG. 1, however with the difference that secondary air is supplied by openings 340. The openings 340 deliver the secondary air into a "turning chamber" 350, the turning chamber being a volume delimited by the inner wall 120 and having a larger diameter than the diameter of the inner wall in the vicinity of the outlet of the evaporator 130.

Moreover, in some embodiments (see FIG. 13), no secondary air is supplied. Embodiments without a supply of secondary air can be used with both the evaporator design according to FIGS. 1-9, 11-13 and with the annular evaporator design of FIG. 10.

Operation of the Heating Device

The outer airflow and/or the air/fuel flow inside the fuel evaporator are shown with dashed arrows in FIG. 1. During steady-state operation, the fan supplies air from an atmosphere into the inlet 112, 132 of the heating device 100. A first part of the airflow is directed tangentially between the outer housing 110 and the inner wall 120 forming an annular swirling flow field where said part of the airflow is preheated by convection at the inner wall 120. The heat of the inner wall 120 emanates from the catalytic combustion in the catalytic elements 140, 150. The inlet flow can also first enter the annular channel 116, before entering the outer inlet chamber OIC. Only the axial flow component is shown for the flow in the outer inlet chamber OIC, the mixing chamber MC and the combustion zone, but the flow can also have a tangential component that is not shown. A second part of the airflow is directed tangentially into the upper part of the fuel evaporator 130, through the inner inlet tube 132. The tangential airflow generates a rotating velocity field, a swirl. Liquid fuel is injected from the nozzle 134 of the fuel pipe 133 as droplets accelerated and carried by the tangential airflow into the rotating velocity field. The liquid fuel is injected by a low-pressure pump or by gravity from the fuel nozzle 134 in the center of the tangentially directed airflow. The droplets are accelerated by the velocity in the tangential flow surrounding the fuel supply pipe 133 and further by the strong rotational velocity component in the flow field generated inside the fuel evaporator 130. The described velocity field inside the fuel evaporator 130 creates excellent heat- and mass transfer characteristics at the heated peripheral wall 131*p* of the fuel evaporator 130 where the fuel droplets collide with and impinge upon said wall. The droplets are sufficiently smeared out resulting in a thin fuel film. Further, the thin boundary layer and associated efficient mass transfer creates low fuel vapor pressure at the surface resulting in efficient evaporation and helps to prevent accumulation of heavy hydrocarbon residuals (coking). The airflow is simultaneously heated efficiently. The thin boundary layer/efficient mass transfer further enables substantial oxygen penetration to the peripheral wall 131*p* that, at elevated surface temperatures, enables surface oxidation of possible hydrocarbon residues. At such conditions the risk of gas phase auto ignition at the peripheral wall 131*p* is eliminated due to the high gas velocity at said wall. The evaporation conditions created by the combined features described above give the combustor a pronounced multi-fuel capability and a possibility to use heavier hydrocarbon fuels. The swirl ratio (tangential velocity component divided with axial velocity component) could be in the range of 5-15, and may in one embodiment be 8-12, and may in yet another embodiment be about 10.

The fuel-evaporating device 130 is heated by the combustion in the first catalytic element 140, and at startup by the electrical heating element 141. During the start up process and transition to steady state operation, the fuel-evaporating device 130 is to a gradually increasing extent heated by the combustion in the catalytic element 150.

After the tangential fuel and air inlet in the fuel evaporator 130, the fuel and air mixture flows downstream towards the open end of the fuel evaporator 130. Here, the rotating air and fuel mixture exits the inner inlet chamber IIC of the fuel evaporator 130 radially outwards and downstream, to be mixed with the outer flow supplied from the outer inlet chamber OIC.

This outer airflow, that can be directed tangentially between the outer housing 110 and the inner wall 120, then forms an annular rotating flow field where said part of the air flow is preheated by convection at the wall of the inner housing.

The above flow pattern enables very efficient mixing of the two flows and the mixing length required to create a homogenous mixture is reduced to a minimum. Furthermore, said flow pattern enables efficient trapping of droplets, accidently "bouncing out" of the evaporator due to film-boiling in case of temporarily too high surface temperature in the evaporator. Said trapping function is further increased in the embodiments of FIGS. 11-13.

The two flows are mixed outside of the fuel-evaporating device 130 and continue together downstream (upwardly in FIG. 1) as an annular rotating flow in the annular space between the fuel-evaporating device 130 and the inner wall 120 towards the first catalytic element 140. The mixing is enhanced by the rotating motion of the flows (and by small-scale turbulence, which is generated at the edge of the fuel-evaporating device 130). The annular outer part of the flow, from the outer inlet chamber OIC, is slightly preheated mainly by convection at the inner wall 120. However it can be beneficial with further preheating of this flow before mixing with the central flow from the inner inlet chamber IIC.

The diameter or cross-sectional area of the fuel evaporator 130 may be substantially constant, as shown in FIG. 1, or decrease in the downstream direction of the fuel evaporator 130.

The fuel and air mixture is at least partly combusted in the first catalytic element 140, and additional combustion can take place in downstream catalytic elements, depending on the operating conditions of the heating device 100.

In one embodiment, the fuel is supplied through the fuel nozzle 134 as droplets that are carried by gravity and the airflow towards the peripheral wall of the fuel-evaporating device 130. The simple dripping fuel nozzle 134 or injector is cheap to manufacture. There is no need for a fuel pump, which further reduces the cost of an assembled unit.

The temporal fluctuations in the air/fuel ratio that can result from the intermittent dripping of the liquid fuel will be insignificant since the velocity field at the inlet of the fuel evaporating device 130 and the thin fuel supply pipe 133 ensure small droplet volume, the evaporation time of each droplet and due to the residence time given by the mixing volume between the fuel-evaporating device 130 and the catalytic element 140 and additionally the vigorous mixing by the large and small scale turbulence at the outlet from the fuel-evaporating device 130. Small fluctuations will have little impact on the combustion, since catalysts normally have a memory effect, i.e. thermal inertia and an oxygen storage capacity, and hence are more dependent on the temporal average air/fuel ratio as opposed to a normal flame.

The heating device 100 is designed with security measures in order to prevent occurrence of backfire. Backfires result if the combustion taking place in one of the catalytic elements 140, 150 is carried upstream towards the fuel evaporating device 130. This is prevented in different ways, which are described below. A first safety feature is introduced by the dimensions of the annular slit in the upstream part of the mixing chamber, MC, such that the flow velocity upstream the catalytic elements is greater than the current flame speed. The flame speed is inter alia given by the laminar flame speed, the air/fuel ratio and the turbulence, and this could be determined for several different operating conditions. Another safety feature comes from the fact that the cell density/mesh number of the catalytic elements is high enough, i.e. the size of their holes small enough, for a flame to be quenched. This means that a catalytically initiated flame is unable to propagate upstream through the catalytic elements 140, 150, thus acting as flame arresters. Moreover, an inert mesh 280 (see e.g. FIG. 10) can be arranged upstream the first catalytic element 250. The inert mesh will act as a flame arrester. A similar mesh can of course also be applied to the embodiments shown in FIGS. 1-9 and 11-13.

During start-up and low power, the fuel-evaporating device 130 is heated by the combustion taking place in the first catalytic element 140 and to a lesser extent by the other catalytic elements 150. The temperature of the fuel-evaporating device 130 should be kept at a suitable level, and this is achieved in different ways by using the specific characteristics of catalytic combustion.

In a first case, the wide range of air/fuel ratios of catalytic combustion is used. If the airflow is increased through the combustor without increasing the fuel flow, this will result in a cooling of the first catalytic element 140 and the evaporator 130, due to the increased mass flow and reduced air/fuel ratio. The temperature is increased if the airflow is instead decreased while keeping the fuel flow substantially constant, thus enabling control of the temperature without changing the power output of the heating device. This is not possible with a flame since it will lead to instability and ultimately flame extinction at lean conditions. In a second case, the temperature can also be reduced by increasing the overall flow rate, i.e. the power of the combustor, without changing the air/fuel ratio. This will lead to incomplete combustion at the first catalytic element 140 and subsequent combustion at the second 150 and optional third or more catalytic elements. The unburned fuel and air will then not transfer heat to the fuel-evaporating device 130. This feature is not obtainable with a normal flame, since it will lead to blow-off. An increase in temperature will result from a decreased mass flow that leads to a more complete combustion (see further description below). By choosing either of these techniques, depending on the operating condition, the temperature of the fuel-evaporating device 130 can be controlled to a suitable level for each operating condition leading to efficient evaporation of any fuel. This results in a pronounced multi-fuel capability. At low loads, the reaction zone of the combustion is mainly located in the first catalytic element 140. This increases the temperature of the fuel-evaporating device 130, which enables evaporation of possible accumulated hydrocarbon residue in said fuel-evaporating device 130. At high loads, the gas flow is increased and the mass transfer of reactants to the surface of the catalytic element 140 is enhanced. If all reactants reaching said catalytic element 140 are converted, the power developed in the catalytic element 140 increases. However, at a certain flow, all reactants that reach the surface cannot be converted due to mass transfer limitations. The excess gas flow will instead cool the surface of the catalytic element 140, which leads to lowered temperature and a consequent reduction in chemical reaction rate and energy conversion in the catalytic element 140. The excess reactants will be combusted in the downstream-located catalytic element 150, if present. This will gradually move the reaction zone downstream, which at high loads essentially will be located at the second and third catalytic elements 150, 160. This will reduce the surface temperature of the fuel-evaporating device 130 such that the fuel evaporator is suited for continuous evaporation of the fuel. Furthermore, it will reduce the thermal stress on the electrical heating element 141.

Catalytic combustion can be maintained with high efficiency and subsequent low emissions in a wide range of relative air/fuel ratios, $\lambda$. By changing the airflow at a constant load, such as has been described above, the location and temperature of the combustion zone can be adjusted to a position creating a suitable temperature interval for the fuel-evaporating device 130 for efficient evaporation of any fuel. The location of the combustion zone is mainly governed by the flow rate and the temperature is mainly governed by $\lambda$. However, the heat transfer to the fuel evaporation device 130 is dependent on both the temperature and location of the combustion zone and the temperature of the fuel evaporator 130 is additionally dependent on the heat transfer to the incoming air and to the fuel during evaporation.

At startup, only the small first catalytic element 140 and the part of the fuel-evaporating device 130 which is in close proximity to or in direct contact with the electrical heating element are heated electrically. The temperature of the fuel-evaporating device 130 is so low that only the light fractions of the fuel are evaporated. Hence, the fuel vapour reaching the catalytic element will initially mainly contain light fuel fractions, which enables a fast and low emission light-off in the first catalytic element 140. After light-off, the temperature in the fuel-evaporating device 130 increases rapidly, allowing for the evaporation of the heavier fractions of the fuel and subsequent combustion in the catalytic element 140. This process gives a fast and clean startup with completely vaporized fuel at a minimal consumption of electrical energy. Furthermore, the risk of thermal degradation of the catalyst is limited, due to the complete fuel evaporation.

The above techniques for controlling the temperature of the fuel-evaporating device 130 gives the heating device a pronounced multi-fuel capability, since the evaporation temperature can be adapted for fuels having different heat of vaporization and different vaporization temperatures. The heating device can have different settings depending on which fuel is used, with regards to air/fuel ratio at a given power etc.

If there are large spatial variations in the air/fuel ratio, this may lead to hot spots, which in turn lead to thermal degradation of the catalytic element(s). This can be avoided by thorough mixing upstream of the catalytic elements, e.g. by creating a velocity field with a strong rotational component as mentioned above. Furthermore, the strong rotational component gives an increased local velocity where the air/fuel mixture enters the first catalytic element, resulting in a substantially enhanced mass transfer rate and very efficient utilization of the catalyst surface.

Typical advantages of a catalytic heating device are their low emissions of unburned hydrocarbons and carbon monoxide, due to the relatively high reaction rate at lean air/fuel ratios, and nitrogen oxides due to the low combustion temperature, well below the temperature where the Zeldovich mechanism begins to have a significant impact on NOx formation, typically 1700 K. The high reaction rate and the thermal inertia of the catalytic elements also make the combustion more stable at lean operating conditions compared to a flame at similar conditions. This further results in high safety, controllability and insensitivity to rapid pressure/flow fluctuations.

The disadvantages of prior art catalytic heating devices are to a great extent overcome by the present invention as given above.

The present invention can be used for many different applications where multi-fuel, catalytic combustion is desirable, such as in vehicle heaters, heat-powered refrigerators and air conditioners, thermoelectric generators, ovens, cooking stoves, heating of exhaust cleaning systems, in small-scale gas turbines and stirling engines.

Even though the present invention has been described as a detailed example, it will be evident to a person skilled in the art to make modifications without departing from the scope of the invention as defined by the appended claims.

The fuel injection and mixing process according to the invention provides complete fuel evaporation without accumulation of heavy hydrocarbon residue and near perfect fuel distribution and fuel-air mixing with very low fuel pressure and no preheating of air (no heat exchanger). The collision and impinging of the fuel drops upon the heated peripheral wall of the fuel evaporator, efficiently prohibits said fuel drops to continue with the flow towards the catalytic element(s). This is further prevented by the strong rotational component in the flow forcing the droplets towards the periphery, and the fuel droplet size generated in the evaporator, which is big enough to prohibit droplets from travelling with the axial component in the air flow towards the catalytic elements.

The invention claimed is:

1. A heating device for combustion of liquid fuels, said device comprising:

at least one catalytic element for catalytically burning a mixture of fuel and air, a fuel supply means being disposed on an upstream side of said at least one catalytic element, an air supply means being disposed on the upstream side of said at least one catalytic element, a fuel-evaporating device having a substantially axisymmetric shape and having an upstream end and a downstream end, said fuel-evaporating device being heated, during operation, by the at least one catalytic element, and being supplied fuel and air from the fuel supply means and the air supply means, an outer housing, for containing said at least one catalytic element and said fuel-evaporating device, an inner wall disposed between the outer housing and said fuel evaporating device, the inner wall having the form of a downwardly projecting frustum with its downstream end located at and in fluid communication with a downstream end of said fuel evaporating device, wherein the upstream end of the fuel-evaporating device is closed, wherein the fuel-evaporating device is provided with at least one inner inlet pipe in a generally upstream end thereof, which said at least one inner inlet pipe is arranged to inject fuel from the fuel supply means and air from the air supply means in a tangential direction into the generally upstream end of the fuel-evaporating device such that a rotational flow is obtained in the fuel-evaporating device from the generally upstream end to the downstream end, wherein the upstream end of the fuel-evaporating device has a larger diameter than the downstream end of the fuel-evaporating device, and the generally upstream end of the fuel-evaporating device is arranged in a vicinity of the at least one catalytic element, wherein the heating device is constructed so that the fuel from the fuel supply means and the air from the air supply means flow toward the downstream end of the fuel evaporating device, leave the fuel evaporating device, and thereafter flow in an opposite direction, and wherein an electric heating element is provided in the vicinity of, or in contact with, the at least one catalytic element and/or the fuel-evaporating device.

2. A heating device according to claim 1, wherein the inner wall is coupled to the outer housing at their upper ends, such that an outer inlet chamber is formed there-between, wherein the outer inlet chamber further is provided with an outer inlet pipe connected to the upstream portion of the outer inlet chamber for delivering further air and wherein the outer inlet pipe is arranged to direct the air flow into the outer inlet chamber.

3. A heating device according to claim 2, wherein the outer inlet pipe is arranged to direct the air flow such that a tangential flow component is obtained.

4. A heating device according to claim 1, wherein the upstream end of the fuel evaporating device penetrates through the at least one catalytic element.

5. A heating device according claim 1, wherein a second inner inlet pipe is connected to the fuel evaporation device for directing a flow of air and/or fuel in a tangential direction, in order to induce a more powerful and more symmetric "swirl" to the fuel and air therein.

6. A stove comprising a heating device according to claim 1.

7. A vehicle heater comprising a heating device according to claim 1.

8. A heating device according to claim 1, wherein the downstream end of the fuel-evaporating device has an outlet opening, and the fuel-evaporating device is constructed so that fuel enters the fuel-evaporating device at the upstream end and exits the fuel-evaporating device at the downstream end.

* * * * *